United States Patent [19]

Lorenz

[11] Patent Number: 4,997,087

[45] Date of Patent: Mar. 5, 1991

[54] LAMP WRAPPER AND BLANK

[75] Inventor: Achim R. Lorenz, Marietta, Ga.

[73] Assignee: MacMillan Bloedel Containers, Atlanta, Ga.

[21] Appl. No.: 434,244

[22] Filed: Nov. 13, 1989

[51] Int. Cl.[5] ..... B65D 85/42

[52] U.S. Cl. ..... 206/422; 206/591; 229/120.14; 229/120.32; 229/DIG. 9

[58] Field of Search ..... 206/422, 420, 419, 418, 206/591; 229/120.14–120.16, 120.32, DIG. 9

[56] References Cited

U.S. PATENT DOCUMENTS

| | | | |
|---|---|---|---|
| 1,361,318 | 12/1920 | Ephlin | 229/DIG. 9 |
| 1,686,273 | 10/1928 | Goodspeed . | |
| 2,165,083 | 7/1939 | Wellman | 206/418 |
| 2,823,797 | 2/1958 | Amatel . | |
| 2,870,949 | 1/1959 | Cumivan | 206/591 |
| 3,053,431 | 9/1962 | Jacobs | 206/422 |
| 3,138,256 | 6/1964 | Miessler, Sr | 206/422 |
| 4,003,516 | 1/1977 | Commerford et al. | 229/DIG. 9 |
| 4,159,797 | 7/1979 | Roozee . | |
| 4,231,510 | 11/1980 | Beard | 206/422 |

FOREIGN PATENT DOCUMENTS

| | | | |
|---|---|---|---|
| 1070233 | 7/1954 | France | 206/418 |
| 283297 | 1/1928 | United Kingdom | 206/418 |

*Primary Examiner*—Bryon P. Gehman

*Attorney, Agent, or Firm*—Shlesinger & Myers

[57] ABSTRACT

A lamp wrapper is formed from a blank having four side wall panels and a joint forming flap interconnected by a set of spaced, substantially parallel fold lines and adapted to form a tubular sleeve. An axial central partition is formed by a partition flap formed in part from and foldably connected to a first top wall panel and adhesively connected at its opposite end to a second partition flap formed from and foldably connected to a second wall panel located on the opposite side of the wrapper to the first panel. The partition is evenly spaced from opposite longitudinal ends of the sleeve and functions to separate the base ends of a pair of light bulbs packaged in the sleeve. In a second embodiment the second wall panel is extended and is foldably connected to yet another wall panel which in turn is connected to a second top panel which connects to the first top panel and defines a second sleeve in side by side relationship with the first sleeve. A second partition flap and a second glue flap combine to form a second partition essentially the same as in the first sleeve but extending across the second sleeve.

8 Claims, 3 Drawing Sheets

LAMP WRAPPER AND BLANK

FIELD OF THE INVENTION

The present invention relates to a lamp wrapper. More particularly the present invention relates to an economic lamp wrapper having a central partition to separate the base portion of a pair of light bulbs.

BACKGROUND OF THE PRESENT INVENTION

It is well known that many light bulbs are used and require regular replacement. In most cases light bulbs are sold to the general public in pairs packaged in a sleeve with the bulb end of one bulb exposed at one end of the sleeve and the bulb end of the other exposed at the other end of the sleeve and the two smaller diameter base ends in overlapping relationship adjacent the centre of the sleeve.

To protect the bulbs and cushion them such sleeves are normally formed from a single face material, i.e. laminate of a liner and a corrugated medium with the corrugations projecting inward and with the longitudinal axis of the corrugations extending substantially circumferentially of the sleeve to resist axial movement of the bulbs from the sleeve. Usually a small flute size such as an E-flute is used to form the corrugations in the medium. Spacing between the wall of the tube is normally designed for the size bulb to be packaged so that the corrugations are compressed slightly by the bulb end of the light bulbs when they are inserted in the sleeve.

In a conventional lamp wrapper the partition used to separate the two bulbs extends at an angle across the tubular member from one side wall to an adjacent side wall and from a corner adjacent to one axial end of the sleeve towards a diagonally opposite corner adjacent to the other axial end of the sleeve. The partition for forming this partition is made from material that extends from the manufacturer's joint forming flap and which is severed and provided with a diagonal fold line connecting the partition panel to the manufacturer's joint forming flap. In some sleeves a second fold line substantially perpendicular to the fold line connecting the partition to the manufacturer's joint forming flap will extend from one end of the diagonal fold line to provide a flap that rests against the adjacent side wall when the lamp wrapper tube is erected and aids in positioning the partition to extend diagonally across the sleeve from one corner towards the diagonally opposite corner.

It will be apparent that the partition of the prior art provides ample protection for the light bulbs but also requires a significant amount of extra material over and above that necessary to form the sleeve itself since the partition panel is in fact an extension of the manufacturer's joint forming flap. Obviously in forming blanks for producing these lamp wrappers and partition panels of one blank may overlap with another thereby reducing the total board requirements however, even with full overlap extra board equivalent to about half of the width of the partition panel at least is necessary for each wrapper.

Considering that millions of such wrappers blanks are used annually, the extra board required to form the lamp wrappers cumulatively amounts to a significant cost.

BRIEF DESCRIPTION OF THE PRESENT INVENTION

It is an object of the present invention to provide a less expensive lamp wrapper for packaging a pair of light bulbs in end to end overlapping relationship.

It is a further object of the present invention to provide a lamp wrapper for packaging two pairs of light bulbs in end to end overlapping relationship.

Broadly the present invention relates to a lamp wrapper blank comprising a first wall forming panel, a second wall forming panel, a third wall forming panel, a fourth wall forming panel and a joint forming flap means, a first fold line interconnecting said first and second wall forming panels, a second fold line interconnecting said second and third wall forming panels, a third fold line interconnecting said third and fourth wall forming panels and a fold line means connecting said joint forming flap means to said fourth wall forming panel, said first, second and third fold lines and said fold line means forming a set of substantially parallel fold lines, a pair of cooperating partition forming flaps connected respectively to said second and said fourth wall forming panels by a pair of substantially parallel fold lines which are parallel to said set of fold lines and located substantially mid-way between the fold lines of said set of fold lines defining sides of the respective of said wall forming panels in which respective of said pair of fold lines is located, one of said pair of cooperating flaps being defined in the respective said wall forming panels to which its said respective one of said pair of fold lines is formed by a first u-shaped line of severance extending in a first direction from opposite ends of its respective fold line of said pair of fold lines and the other of said pair of flaps being defined by a second line of severance extending in said direction from the other of said fold lines and across an adjacent fold line of said set of fold lines, said pair of partition folding flaps being located centrally of and spaced from the ends of said second and fourth wall forming panels and sized to ensure overlap between said partition forming flaps to define a transverse partition when said blank is assembled and erected into a sleeve.

Preferably one of said partition forming flaps will comprise a main partition flap and will be formed by said second line of severance and will extend across said joint flap means and said other of said pair of partition forming flaps will comprise a partition glue flap formed in said second wall panel.

Preferably a plurality of such blanks are arranged end to end and said portion of said partition forming flap of one of said blanks is cut from a first wall forming panel of an adjacent of said blanks.

Preferably a stripe of adhesive is applied to said blanks before said blanks are separated so that said adhesive stripe traverses the axial length of said first wall forming panel of said adjacent of said blanks and said portion of said partition forming flap of said one blank.

The present invention also relates to a lamp wrapper sleeve formed from said blank wherein said first, second, third and fourth walls are formed into a substantially tubular sleeve by adhesively securing said manufacturer's joint forming flap to said first wall forming panel and said portion of said main partition flap is secured to said partition glue flap to provide a partition extending substantial parallel to said walls for a distance coordinated with the bulb to be packaged therein so that edges of the partition engage their adjacent bulb and force the base of the bulb toward one of said first and said third wall panels.

Preferably said partition forming flaps will be provided with a diagonal fold line extending from one end of said fourth fold line to an edge of said partition panel remote from said one end.

In a further embodiment of the present invention a rectangular sleeve is divided into a pair of axial chambers each of which is divided by partition flaps combining to form partitions as above described.

Preferably a four light bulb wrapper blank will comprise a flap means, a partition panel, a first top panel, a first side panel, a bottom panel, a second side panel, and a second top panel foldably interconnected by a set of substantially parallel fold lines, a first partition forming flap formed at least in part in said first top panel by a substantially u-shaped line of severance the ends of which are interconnected by a connecting fold line substantially parallel to the set of fold lines and connecting the first partition flap to the first top panel, a second partition flap formed at least in part in said second top wall by a substantially u-shaped line of severance and connected to said second top wall by a second connecting fold line substantially parallel to set of fold lines, a third partition forming flap formed in said bottom panel by a substantially u-shaped line of severance the ends of which are interconnected by a third connecting fold line substantially parallel to said set of fold lines, a fourth partition forming flap spaced from said third partition flap and formed in said bottom panel by substantially u-shaped line of severance the ends of which are connected by a fourth connecting fold line substantially parallel to said set of fold lines, said first partition flap and said third partition flap being positioned to be combined to form a first axial partition and said second partition flap and said fourth partition flap being positioned to be secured together to form a second partition said first and second partitions being symmetrically spaced from axial ends of said blank.

Preferably a four light bulb wrapper will comprise a glue flap means, a partition panel, a first top wall, a first side wall, a bottom wall, a second side wall and a second top wall panel all interconnected by a set of substantially parallel fold lines, means connecting said glue flap means to said bottom panel along a line substantially parallel to said set of fold lines, means connecting said first and second top panels to form a sleeve with said second top wall being positioned in overlying relationship to said first top wall and said partition panel dividing said sleeve into a pair of separate side by side article receiving chambers, a first partition flap connected to said first top wall and to a third partition flap which is connected to said bottom wall to provide a first partition means, a second partition flap connected to said second top wall and to a fourth partition flap which is connected to said bottom wall to form a second partition means, said first partition means dividing one of said article receiving chambers and said second partition means dividing said other article receiving chambers each of said partition means being spaced symmetrically from ends of said sleeve.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
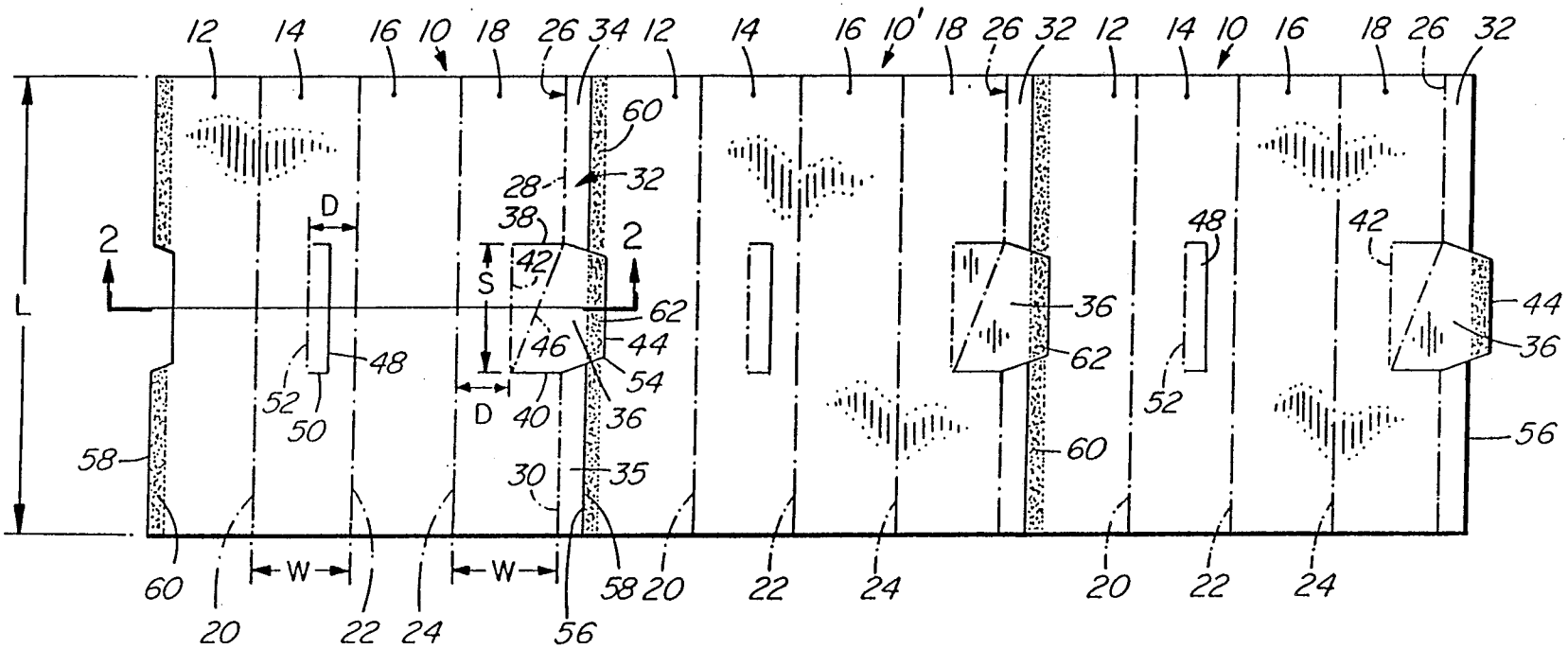
FIG. 1 is a plan view of a series of blanks for forming the lamp wrappers of the present invention arranged in end to end relationship in the manner in which they will be cut from the sheet material in which they are manufactured.
Figure 2:
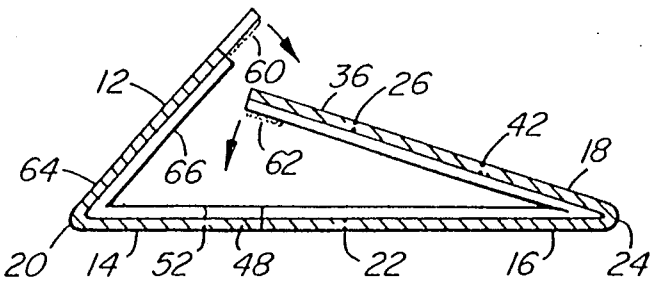
FIG. 2 is a transverse cross section of a blank along the line 2—2 in FIG. 1 showing the blank being folded to form the knock-down lamp wrapper sleeves.

Referring to FIG. 1, a plurality of lamp wrapper, sleeve-forming blanks each indicated by the reference numeral 10 have been shown in end to end relationship as they would normally be cut from a sheet of conventional lamp wrap material. Each blank is essentially the same and thus only one blank will be described in detail.

Each blank 10 is composed of a first wall forming panel 12, a second wall forming panel 14, a third wall forming panel 16 and a fourth wall forming panel 18 interconnected respectively by a first fold line 20, a second fold line 22 and a third fold line 24. A fold line means 26 formed by a pair of aligned spaced fold lines 28 and 30 connects a manufacturer's joint forming flap means 32 which is also divided into two flaps 34 and 36 to the fourth panel 18. The first 20, second 22, third 24 fold lines, and fold line means 26 (lines 28 and 30) form a set of spaced substantially parallel fold lines.

A first partition flap 36 is formed in the panel 18 by a substantially u-shaped line of severance 37 formed by pair of lines of severance 38 and 40 interconnected at end to panel 18 by a line of severance 44 that defines a free end of the flap 36. The opposite end of flap 36 is connected by fourth fold line 42, also substantially parallel to the set of fold lines described above to the panel 18. The first partition flap preferably has a width from free edge 44 to fold line 42 substantially equal to the width (W) of the panels 12 and 16, i.e. the spacing between the fold lines 22 and 24. The first partition forming flap 36 in FIGS. 1 to 6 separates the fold lines 28 and 30 and the manufacturer's joint flap means 32 into the two flaps 34 and 36.

The distance D, i.e. spacing between the parallel fold lines 42 and 24 is equal to approximately one half of the width of the panel 18, i.e. one half width W so that the fold line 42 extends axially of the panel 18 along the midline of the panel 18.

The first partition forming flap 36 is provided with a diagonal fold line 46 that extends in the illustrated arrangement from the junction of the fold line 42 with the cut edge 40 across the flap 36 to the cut edge 38. The precise angle between the fold lines 42 and 46 is not critical. In the illustrated arrangements it is approximately 30°. This fold line 46 facilitates insertion of bulbs into the sleeve and separation of the base ends of the bulbs by permitting the partition flap 36 to bend more easily.

A second partition forming flap 48 (glue flap) is defined in the wall forming panel 14 by a substantially u-shaped line of severance 50 the ends of which are interconnected by a fold line 52 that is substantially parallel to the fold lines of the set of fold lines 22, 24, etc. This fold line 52 is spaced from the fold line 22 by essentially the same distance D as the distance D spacing between the fold lines 42 and 24 which was equal to one half of the width W of the panel 18 and panels 18 and 14 are essentially the same width. In the illustrated wrapper all of the panels, 12, 14 16 and 18 all have essentially the same width W since a tubular sleeve of square cross section is to be formed from the blank.

The first and second partition forming flaps 36 and 48 are positioned symmetrically with respect to the transverse centre line of the blank 10 located mid-way of the length L (i.e. along line 2—2 of FIG. 1) of the blank 10 so that the partition structure formed by interconnection of the flaps 36 and 48 extends across the blank with the edges 38 and 40 spaced substantially the same distances from their respective adjacent axial ends of the blank 10 or a sleeve formed therefrom. In the illustrated arrangement the length of the transverse partition 36 measured axially of the walls, i.e. parallel to the set of fold lines is indicated as S and is equal to approximately one quarter L so that the distance from the edges 38 and 40 of the transverse partition 36 to their adjacent end edges of the blank are approximately $\frac{3}{8}$ of the length L. For a typical light bulb L will be about $6\frac{1}{2}$ inches.

The length S of the partition forming flap 3 is not critical but is correlated with the size of light bulb to be packaged so that the edges 38 and 40 engage the bulb and force it into the desired position as will be described in more detail hereinbelow.

It will be noted that the free edge 44 of the partition flap 36 is formed in the wall panel 12 of the adjacent blank 10 (see the blank indicated at 10' in FIG. 1). Preferably the portion of the flap 36 as indicated generally at 54 extending into the blank 10' will have a width substantially equal to the width of the manufacturer glue flap means 32 measured between the fold line means 26 and the free edge 56 of the manufacturer's joint flap means 32, i.e. the distance between edges 54 and 56 is essentially the same as the distance between edge 56 and line 26.

It will be apparent that the free edge 56 of the manufacturer's glue flap 32 also forms the free edge of the adjacent edge of the panel 12 as indicated at 58 of the blanks 10.

A longitudinally extending stripe of adhesive 60 is applied to the panels 12 adjacent the free edges 58 thereof and traverses the portion 54 of the partition forming flap 36 to provide a strip of adhesive extending substantially the full length L of the blank and having a portion 62 on the portion 54 of the transverse partition 36.

It will be apparent from the above that a minimum amount of material is necessary to form a blank and that only a single stripe of adhesive need be applied longitudinally of the blank to secure all the parts together to form the partitioned wrappers as will be described below.

To assemble a blank 10 into a knocked-down sleeve or tube the wall panel 18 and thus the manufacturer's joint forming flap 36 is folded relative to the rest of the blank along fold line 24 to move the panel 18 into face to face relationship with the panel 16 and the portion 54 of the partition forming flap 36 into overlying face to face relationship with the glue flap 48 in the wall 14. The adhesive stripe 62 on the portion 54 of the transverse partition flap 36 overlaps with and secures the flap 36 to the glue flap 48.

The blank is then further folded along the fold line 20 to fold the panel 12 into overlying relationship with the panel 14 and to bring the edge 58 of the panel 12 substantially into alignment with the fold line means 26 connecting the manufacturer's glue flap 32 to the panel 18. The adhesive strip 60 on the panel 12 contacts the flap 32 and secures the panel 12 to the manufacturer's joint flap 32 to complete the gluing of the tubular wrapper.

Figure 3:
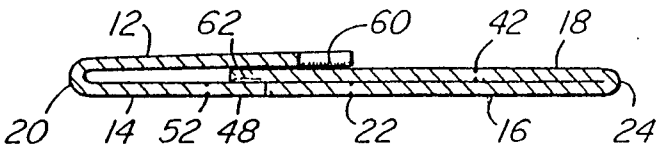
FIG. 3 is a similar cross section to FIG. 2 but showing the lamp wrapper formed as a knock-down sleeve.
Figure 4:
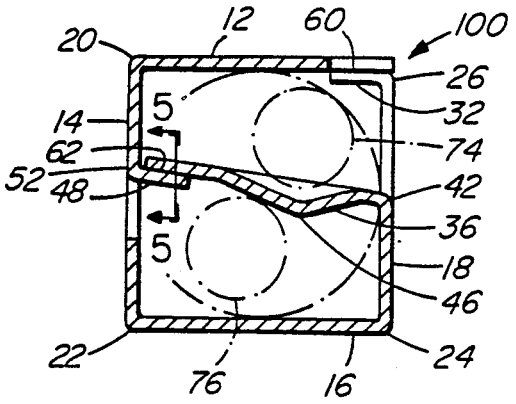
FIG. 4 is a cross section also along the line 2—2 of FIG. 1 but showing the sleeve in erected form.

Erecting a knocked-down wrapper of FIG. 3 to tubular form as shown in FIG. 4 is simply a matter of holding one corner or fold line, e.g. fold line 24 in fixed position and moving the opposite fold line 20 towards the fold line 24 to move the fold lines 20 and 24 into diagonally opposed positions as shown in FIG. 4.

Figure 5:
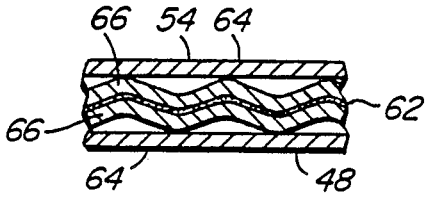
FIG. 5 is a section along the line 5—5 of FIG. 4 showing the securing the partition forming flap to the partition glue flap.

As above indicated the lamp wrapper is normally formed of a single face corrugated material. This is more clearly illustrated in FIGS. 2 and 5 wherein the material forming the blank is illustrated as composed of a liner ply 64 and a corrugated medium ply 66. The axis of the corrugations extend substantially perpendicular to the length L and the medium 66 is located on the inside of the sleeve. The adhesive strip 60 and thus the portion 62 as shown in FIG. 5 is applied to the corrugated medium 66 and secures the two faces of corrugated medium 66 together when securing the partition flap 36 to the partition glue flap 48.

Figure 6:
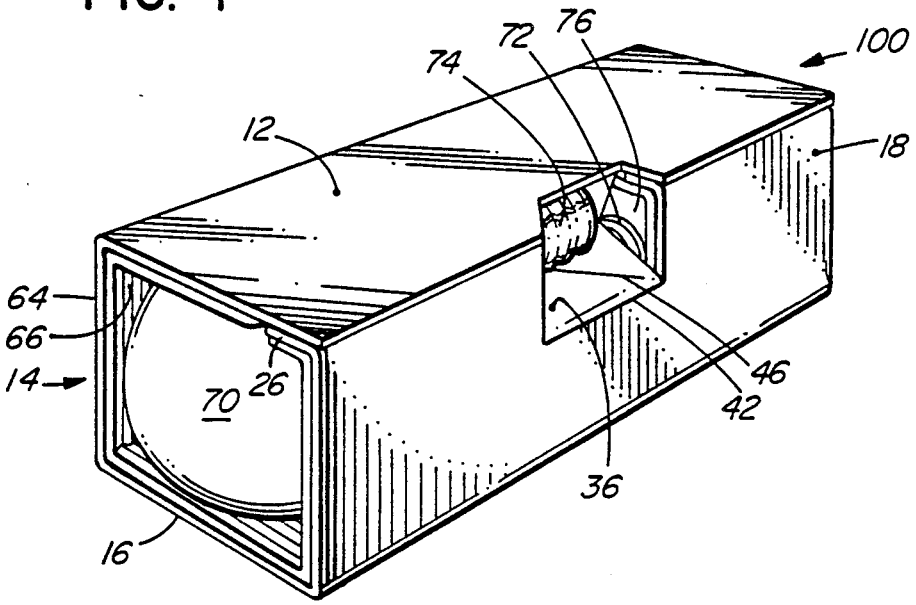
FIG. 6 is an isometric of the lamp wrapper sleeve of the present invention with a pair of light bulbs in end to end relationship with their base portions overlapping.

The sleeve is squared to form the wrapper 100 as illustrated in FIG. 4 and 6 and is used to package light bulbs such as the light bulbs 70 and 72 arranged to extend into the tube from opposite axial ends so that the base end 74 of one bulb 70 extends on one side of the partition 36 and the base 76 of the other bulb 72 on the opposite side of the partition. The width of the side 12, 14, 16 and 18 of the sleeve 100 is matched with the diameter of the bulb end of the light bulbs 70 and 72 so that the bulbs are snugly received within the sleeve. The widths of the partition 36 is sufficient to ensure that the edge of the partition as defined by the cut edges 38 and 40 engage the tapered portion of their adjacent light bulb and force the base portions 74 and 76 in the illustrated arrangement toward the partition walls 12 and 16 respectively thereby to securely hold the bulb in position with the corrugations cushioning the bulbs to resist damage or breakage. The fold line 46 facilitates definition of the partition as illustrated in FIG. 4 which in turn helps to deflect the bases of the bulbs toward the side walls 12 and 16.

Figure 7:
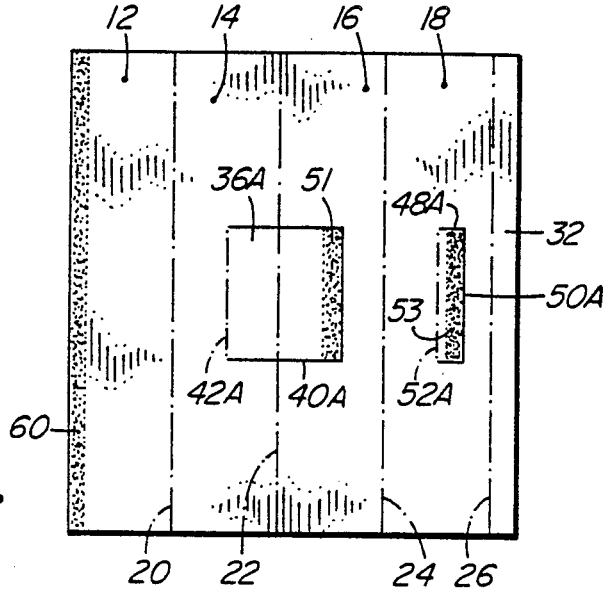
FIG. 7 is a plan view of a blank similar to FIG. 1 but illustrating a modified single lamp wrapper blank.

FIG. 7 shows a blank for forming a single sleeve similar to that of FIG. 1 but wherein the first partition forming flap 36A has been formed in the panels 14 and 16 and whereas the second partition forming flap 48A has been formed in the panel 18. This permits the fold line 26 to be continuous and the manufacturer's glue flap 32 also to be a single flap.

The embodiment of FIG. 7 is formed into a sleeve in substantially the same manner as the FIG. 1 embodiment that is by folding on fold line 24 to position the panel 18 in overlying relationship with the panel 16 and position the flaps 36A and 48A in overlying relationship. A line of adhesive such as that indicated at 51 may be provided on the flap 36A or at 53 may be provided on the flap 48A to secure these two flaps together. Next the blank is folded along the line 20 to move the panel 12 into face to face relationship with the panel 14 and position the line of adhesive 60 directly over the glue flap 32 to secure the sleeve together.

Figure 8:
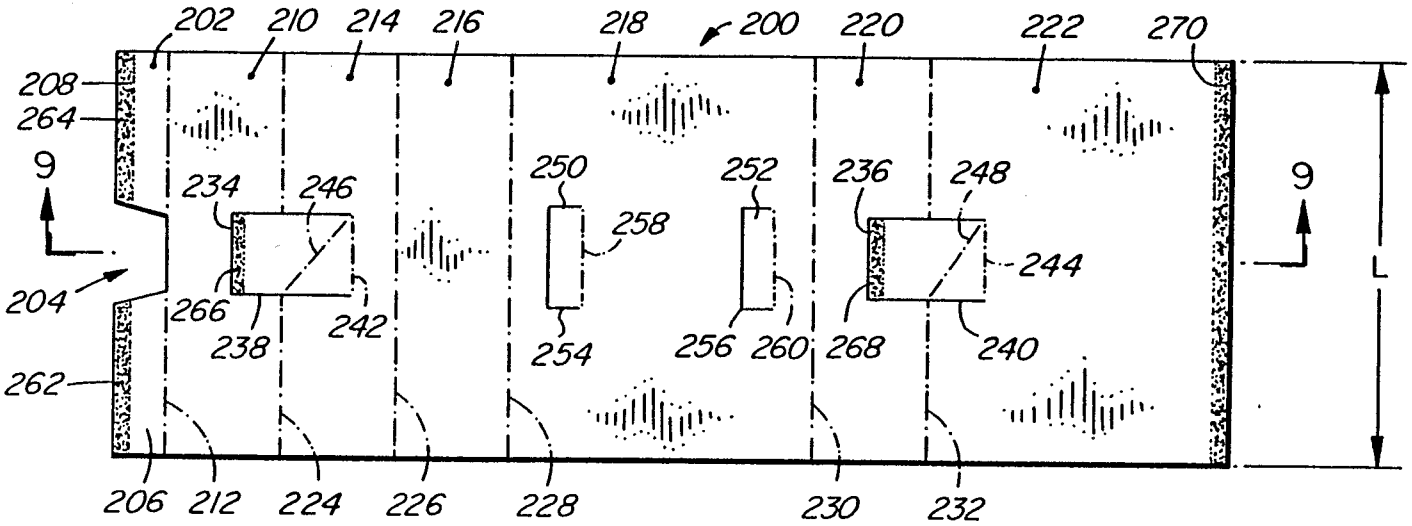
FIG. 8 is a plan view of a blank similar to FIG. 1 but adapted to hold 4 lamps instead of 2.
Figure 10:
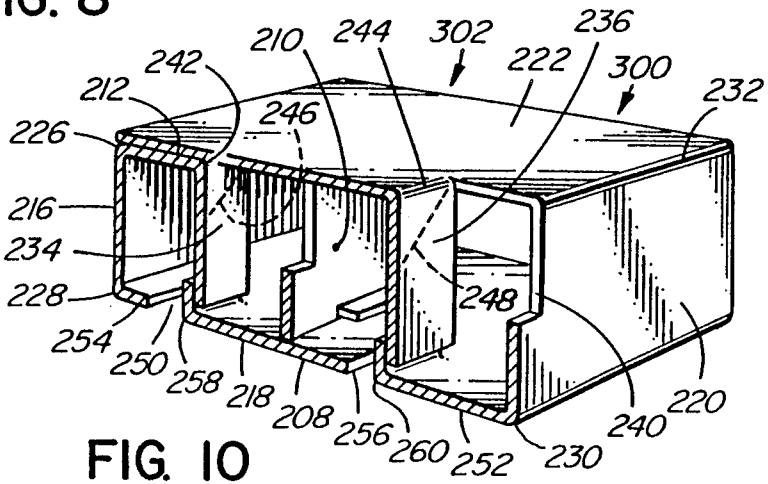
FIG. 10 is a section along the lines 9—9 of FIG. 8 showing an erected lamp wrapper (one end thereof) as an isometric view.
Figure 9:
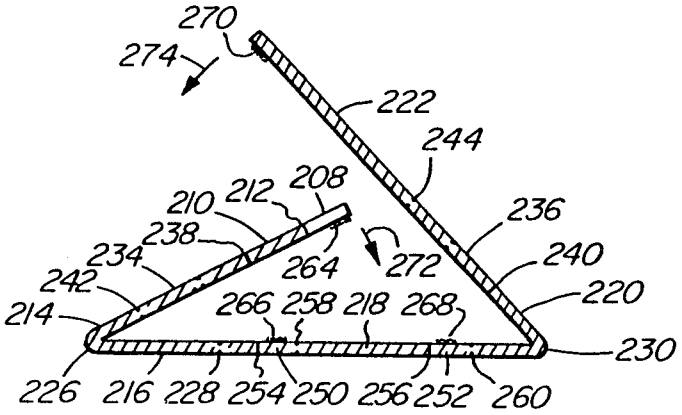
FIG. 9 is a view similar to FIG. 2 but taken along the lines 9—9 of FIG. 7 showing the blank of FIG. 7 being folded to form a knock down lamp wrapper sleeve.

The embodiment illustrated in FIG. 8–10 is similar to that shown in FIGS. 1–6 inclusive but is adapted to contain four instead of two light bulbs.

The blank 200 from left to right includes a glue flap 202 which is divided by cut-out 204 into a pair of flaps 206 and 208 and is connected to a partition panel 210 by a fold line 212. The partition panel 10 forms one of a series of parallel panels 210, 214, 216, 218, 220 and 222 interconnected by a set of substantially parallel fold lines 224, 226, 228, 230, and 232 respectively. The panel 214 forms a top wall 216, a side wall 218, a bottom wall 220, a second side wall and 222 a second top wall. Suitable (first and third) partition forming flaps 234 and 236 are cut respectively from panels 210, 214 and 220, 222 respectively by substantially u-shaped fold lines 238 and 240 respectively. The partition flap 234 is secured to the panel 214 via the fold line 242 which is substantially parallel to the set of fold lines 212, 224, 226, 228, 232. Similarly the flap 36 is connected to the panel 222 via the fold line 244. Each of these flaps 234 and 236 is divided by a diagonal fold line 246 and 248 respectively.

The flaps 234 and 236 function in essentially the same manner as the flap 34 in the FIG. 1–6 embodiment.

Each of the partition flaps 234 and 236 is adapted to cooperate with a cooperating partition forming flap (glue flaps) as indicated at 250 and 252 (fourth flap) respectively which are defined in the panel 218 by substantially u-shaped lines of severance 254 and 256 and fold lines 258 and 260 respectively. The fold line 258 interconnects the ends of the line of severance 254 while the fold line 260 interconnects the ends of u-shaped line of severance 256.

It will noted that the fold lines 258 and 260 are on the same side, i.e. to the right of the lines of severance 254 and 256 respectively.

The blank 200 will be printed with adhesive stripes substantially parallel to the set of fold lines 212, 224, 226, 228, 230 and 232 as indicated at 262 and 264 on the flaps 206 and 208 at 266 and 268 on the flaps 234 and 236 and at 270 on the panel 222. It will be noted that the stripes 262, 264 and 270 are all positioned adjacent the free edge of their respective flaps or panels and the stripes 266 and 268 could, if desired, be printed on the partition flaps 250 and 252 respectively adjacent the ends thereof remote from their fold lines connection 258 and 260 respectively.

To produce a lamp wrapper from the blank of FIG. 7 the flap 200 and panels 210 and 214 are folded on fold line 226 as indicated by the arrow 272 in FIG. 9 to move the panel 214 into face to face relationship with the panel 216 and the flap 208 into face to face relationship with the panel 218 so that the line 212 substantially aligns with the transverse centre line of the panel 218. The flap 234 is moved into face to face relationship with the partition glue flap 250 so that the edge of flap 234 remote from the fold line 242 is adjacent to and substantially parallel to the fold line 256.

The glue stripe 262 and 264 secure the flap 202 to the panel 218 while the adhesive stripe 266 secures the free end of the partition flap 234 to the partition glue flap 250.

The panels 220 and 222 are then folded as indicated by the arrow 274 into overlying relationship with the panel 218 and the panels 212 and 214 as well as the flap 202. This brings the free end of partition flap 236 remote from the fold line 244 into overlying relationship with the second partition glue flap 252 and into contact with the adhesive stripe 268 thereon. Similarly the glue stripe 270 is brought into face to face relationship with the panel 214 along a line positioned between the fold lines 242 and 226 thereby to secure the panel 222 to the panel 214.

If desired, the panel 222 may be made shorter, i.e. the distance from the fold line 232 to the free edge thereof may be shortened to simply overlap and provide a glue line overlapping with the panel 214. If the glue line overlaps the panel 214 in the area of the glue flap 234 it will be necessary to divide the glue line 270 into two separate and distinct lengths therebetween in which the flap 234 is received so that the partition flap 234 is free to move into a transverse position as will be described in more detail below.

After the blank has been glued by folding on fold lines 226 and 230, i.e. substantially to 180° on each fold line permitting the adhesive to set, the lamp wrapper, as indicated at 300 in FIG. 10 may then be erected or squared by folding the panel 216 relative to panel 218 on fold line 228 position the panels 216 and 218 substantially perpendicular to each other as illustrated in FIG. 9. This inherently results in folding of the partition panel 234 secured to the glue flap 250 to a position substantially parallel with the panel 216. Similarly the partition panel 210 and the partition flap 236 are moved in a position substantially parallel to the wall 216 as is the side wall panel 220.

The erect lamp wrapper is illustrated in FIG. 9 is adapted to receive four light bulbs in opposing relationship, two on each side of the partition of the panel 210 with their bases separated by the partitions 234 and 236 in the same manner as described hereinabove with respect to the FIG. 1–6 in mind, i.e. in the illustration in FIG. 9 which shows only half of the carton, the bulb end of a pair of light bulbs would be exposed at the end designated at 302 and their bases would extend on one side of the partitions 234 and 236 respectively and similarly a pair of bulbs would be positioned in the opposite end (not shown) with their bases extending inwardly and positioned on the other side of the partitions 30, 34 and 236 respectively.

Having described the invention modifications will be evident to those skilled in the art without departing from the spirit of the invention as defined in the appended claims.

I claim:

1. A lamp wrapper blank comprising a first wall forming panel, a second wall forming panel, a third wall forming panel, a fourth wall forming panel and a joint forming flap means, a first fold line interconnecting said first and second wall forming panels, a second fold line interconnecting said second and third wall forming panels, a third fold line interconnecting said third and fourth wall forming panels and a fold line means connecting said joint forming flap means to said fourth wall forming panel, said first, second and third fold lines and said fold line means forming a set of substantially parallel fold lines, a pair of cooperating partition forming flaps connected respectively to said second and said fourth wall forming panels by a pair of substantially parallel fold lines which are parallel to said set of fold lines and located substantially mid-way between the fold lines of said set of fold lines defining sides of the respective of said wall forming panels in which respective of said pair of fold lines is located, one of said pair of cooperating flaps being defined in the respective of said wall panels to which its said respective one of said pair of fold lines is formed by a first u-shaped line of severance extending in a first direction from opposite ends of its respective fold line of said pair of fold lines and the other of said pair of flaps being defined by a second u-shaped line of severance extending in said direction from the other of said fold lines of said pair of fold lines and across an adjacent fold line of said set of fold lines, said pair of partition forming flaps being located centrally of and spaced from the ends of said second and fourth wall forming panels and sized to ensure overlap between said partition forming flaps to define a transverse partition when said blank is assembled and erected into a sleeve.

2. A wrapper blank comprising a first wall forming panel, a second wall forming panel, a third wall forming panel, a fourth wall forming panel and a manufacturer's joint forming flap means, a first fold line interconnecting said first and second wall forming panels, a second fold line interconnecting said second and third wall forming panels, a third fold line interconnecting said third and fourth wall forming panels and a fold line means connecting said manufacturer's joint forming flap means to said fourth wall forming panel, said first, second and third fold lines and said fold line means forming a set of substantially parallel fold lines, a partition forming flap connected to said fourth wall forming panel via a fourth fold line substantially parallel to said set of fold lines and located substantially mid-way between said third fold line and said fold line means, said partition forming flap being cut from said fourth wall forming panel and said manufacturer's joint forming flap means and extending beyond said manufacturer's joint forming flap means in a direction perpendicular to said set of fold lines, a partition joining flap formed in said second panel by a line of severance terminating at opposite ends in a fifth fold line, said fifth fold line being substantially parallel to said set of fold lines and located substantially mid-way between said first and said second fold lines, said partition forming flap and said partition joining flap being located centrally of and spaced from ends of said second panel and said fourth panel and sized to ensure overlap between said partition forming flap and said partition joining flap.

3. A blank as defined in claim 2 wherein said partition forming flap is provided with a diagonal fold line extending from one end of said fourth fold line to an edge of said partition foring flap remote from said one end.

4. A lamp wrapper sleeve comprising first, second, third and fourth wall panels interconnected by a set of substantially parallel fold lines defining the corners of a substantially tubular sleeve having open ends, a joint forming flap means foldably attached to said fourth wall panel and adhesively connected to said first wall panel, a pair of cooperating partition forming flaps, one of said pair of partition forming flaps formed from a portion of said fourth wall panel and connected thereto by a fourth fold line extending parallel to said set of fold lines substantially mid-width of said fourth wall panel and the other of said pair of partition forming flaps formed from said second wall panel and connected thereto by a fifth fold line extending substantially parallel to said set of fold lines and substantially at mid-width of said second wall panel, means securing together said pair of partition forming flaps to form a partition extending across said sleeve between said second and fourth walls and symmetrically spaced relative to said open ends of said sleeve.

5. A sleeve as defined in claim 4 wherein said partition has a length measured axially of said sleeve coordinated with a bulb to be packaged therein so that edges of the partition engage an adjacent bulb received in said sleeve and force a base of said bulb toward one of said first and said third wall panels.

6. A sleeve as defined in claim 5 wherein said partition is provided with a diagonal fold line extending from one end of said fourth fold line to an edge of said partition remote from said one end.

7. A blank sheet comprising a plurality of blanks, each said blank having a first wall forming panel, a second wall forming panel, a third wall forming panel, a fourth wall forming panel and a manufacturer's joint forming flap means, a first fold line interconnecting said first and second wall forming panels, a second fold line interconnecting said second and third wall forming panels, a third fold line interconnecting said third and fourth wall forming panels and a fold line means connecting said manufacturer's joint forming flap means to said fourth wall forming panel, said first, second and third fold lines and said fold line means forming a set of substantially parallel fold lines, a partition forming flap connected to said fourth wall forming panel via a fourth fold line substantially parallel to said set of fold lines and located substantially mid-way between said third fold line and said fold line means, said partition forming flap being cut from said fourth wall forming panel and said manufacturer's joint forming flap means and extending beyond said manufacturer's joint forming flap means in a direction perpendicular to said set of fold lines, a partition joining flap formed in said second panel by a line of severance terminating at opposite ends in a fifth fold line, said fifth fold line being substantially parallel to said set of fold lines and located substantially mid-way between said first and said second fold lines, said forming partition flap and said partition joining flap being located centrally of and spaced from ends of said second panel and said fourth panel and sized to ensure overlap between said partition forming flap and said partition joining flap, said blanks of said plurality of blanks arranged end to end with a free edge of said manufacturer's joint forming flap means of one of said plurality of blanks in edge to edge relationship with a free edge of said first wall forming panel of an adjacent blank of said plurality of blanks and wherein said portion of said partition forming flap of said one of said blanks is cut from said first wall forming panel of said adjacent of said blanks.

8. A blank sheet as defined in claim 7 further comprising a stripe of adhesive substantially parallel to said set of fold lines applied to said one of said blanks and said adjacent of said blanks extending from one end to the opposite end of said first wall forming panel of said one of said blanks and over said portion of said partition forming flap of said adjacent of said blanks.

* * * * *